US006990771B2

(12) United States Patent
Pfaff

(10) Patent No.: US 6,990,771 B2
(45) Date of Patent: Jan. 31, 2006

(54) INERTIAL CONTROL SYSTEM FOR OPENING AND CLOSING MULTIPLE SLIDING DOORS IN A COMMON DIRECTION

(75) Inventor: Eric Dant Pfaff, Phoenix, AZ (US)

(73) Assignee: Architectural Automations, L.L.C., Scottsdale, AZ (US)

( * ) Notice: Subject to any disclaimer, the term of this patent is extended or adjusted under 35 U.S.C. 154(b) by 119 days.

(21) Appl. No.: 10/246,382

(22) Filed: Sep. 18, 2002

(65) Prior Publication Data

US 2004/0049984 A1 Mar. 18, 2004

(51) Int. Cl.
*E05F 17/00* (2006.01)

(52) U.S. Cl. ..... 49/94; 49/116; 160/197

(58) Field of Classification Search ..... 49/94, 49/116, 123, 125, 127, 128, 130; 160/197, 160/202, 120, 241, 114, 183; 4/607
See application file for complete search history.

(56) References Cited

U.S. PATENT DOCUMENTS

| | | | | | |
|---|---|---|---|---|---|
| 342,374 | A | * | 5/1886 | Morgan | 49/123 |
| 834,673 | A | * | 10/1906 | Hussey et al. | 49/130 |
| 1,018,777 | A | * | 2/1912 | Potvin | 160/118 |
| 1,098,516 | A | * | 6/1914 | Matthews | 160/195 |
| 1,534,981 | A | * | 4/1925 | McKinney | 49/123 |
| 1,574,347 | A | * | 2/1926 | Hackman | 49/127 |
| 1,613,429 | A | * | 1/1927 | Alvey | 296/140 |
| 1,653,066 | A | * | 12/1927 | Senter | 296/98 |
| 2,799,333 | A | * | 7/1957 | Baroni | 160/114 |
| 2,819,498 | A | * | 1/1958 | Grossman | 49/130 |
| 2,882,890 | A | * | 4/1959 | Shaw | 126/273 R |
| 3,990,183 | A | * | 11/1976 | Meggs et al. | 49/125 |
| 4,279,454 | A | * | 7/1981 | Koiso et al. | 312/297 |
| 4,388,778 | A | * | 6/1983 | Brooke | 49/125 |
| 4,428,491 | A | * | 1/1984 | Mittelmann et al. | 220/1.5 |
| 4,565,031 | A | * | 1/1986 | Sakamoto | 49/130 |
| 4,616,451 | A | * | 10/1986 | Glick | 52/66 |
| 4,662,709 | A | * | 5/1987 | Brueggemann | 359/216 |
| 4,720,876 | A | * | 1/1988 | Tomei et al. | 4/614 |
| 4,800,945 | A | * | 1/1989 | Arteaga | 160/196.1 |
| 4,903,433 | A | * | 2/1990 | Baus | 49/40 |
| 4,945,586 | A | * | 8/1990 | Cross et al. | 5/414 |
| 4,998,577 | A | * | 3/1991 | Kobayashi et al. | 160/202 |
| 5,548,926 | A | * | 8/1996 | Sjoholm | 49/127 |
| 5,659,160 | A | * | 8/1997 | Tracey | 187/316 |
| 5,711,112 | A | * | 1/1998 | Barten et al. | 49/118 |
| 5,911,519 | A | * | 6/1999 | Eutebach | 4/607 |
| 6,360,487 | B1 | * | 3/2002 | Kern et al. | 49/231 |

* cited by examiner

*Primary Examiner*—Gregory J. Strimbu
(74) *Attorney, Agent, or Firm*—Tod R. Nissle, P.C.

(57) ABSTRACT

An access system for a building structure includes an access opening formed in the structure and a horizontally oriented track extending across the opening. Panels are slidably mounted on the track. A pulley—track system opens and closes the panels. The system is controlled with a manually operated control panel mounted on the building structure.

1 Claim, 7 Drawing Sheets

INERTIAL CONTROL SYSTEM FOR OPENING AND CLOSING MULTIPLE SLIDING DOORS IN A COMMON DIRECTION

BACKGROUND OF THE INVENTION

Sliding doors are widely used in building structures. Many light weight sliding doors are opened by hand; for example, sliding patio glass doors commonly found in homes. Other sliding doors are provided in pairs which open and close by moving each door in a direction opposite that of the other door. Such conventional systems for opening and closing sliding doors do not appear to be adapted to opening a plurality of doors in a common direction.

BRIEF SUMMARY OF THE INVENTION

This invention relates to access systems for building structures. More particularly, the invention relates to a method and apparatus for opening sliding doors by displacing multiple door panels in a common direction of travel. In a further respect, the invention relates to a method and apparatus for opening sliding doors that are difficult to open because of their extreme weight and because weather proofing seals on the doors create significant frictional resistance opposing movement of the doors. Accordingly, it would be highly desirable to provide an improved building access system for opening a plurality of sliding doors in a common direction.

Still a further object of the invention is to provide an improved building access system for simultaneously opening a first group of sliding doors in a first direction and a second group of sliding doors in a second direction opposite the first direction.

BRIEF DESCRIPTION TO THE DRAWINGS

These and other, further and more specific objects and advantages of the invention will be apparent to those of skill in the art from the following detailed description thereof, taken in conjunction with the drawings, in which.

DETAILED DESCRIPTION OF THE INVENTION

Figure 3:
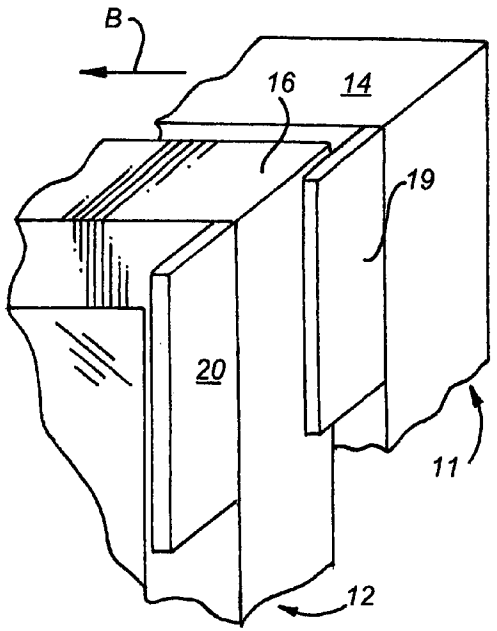
FIG. 3 is a perspective view illustrating a latching mechanism that causes one sliding door panel to displace and pull another when an access system comprising a plurality of parallel sliding offset door panels is being opened.
Figure 2:
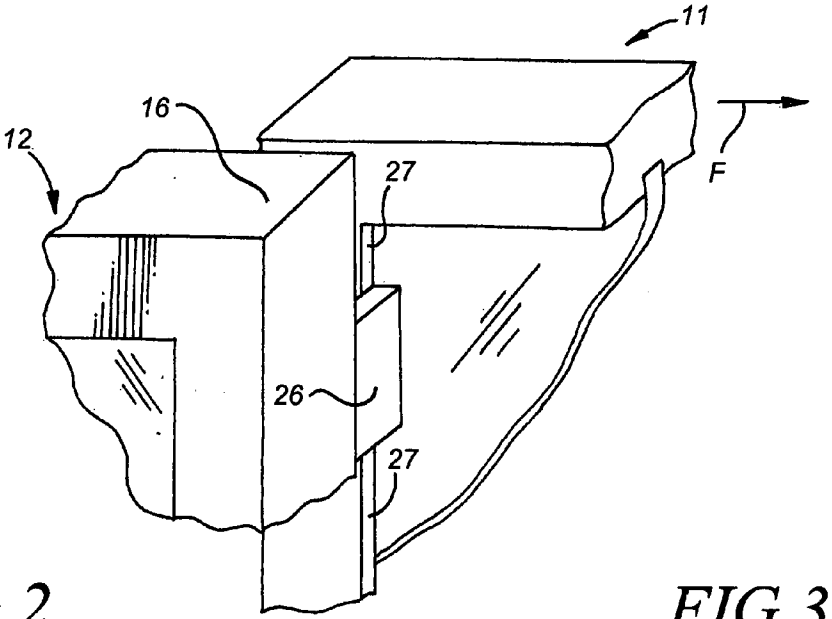
FIG. 2 is a perspective view illustrating a latching mechanism that causes one sliding door panel to be pulled by the another panel when an access system comprising a plurality of parallel sliding offset door panels is being closed.

Briefly, in accordance with the invention, I provide an improved access system for a building structure. The access system includes an access opening formed in the building structure and having first and second sides; a horizontally oriented track extending across the opening; at least first and second panels slidably mounted in the access opening on the track, each of the panels including a leading portion and a rear portion, at least the first of the panels including a catch mounted on the leading portion, the catch shaped and dimensioned to contact the leading portion of the second panel and pull the second panel simultaneously with the first panel when the first panel is moving in a selected direction; a first rotatable pulley mounted at a position lateral from the first side; a second rotatable pulley mounted at a position lateral from the second side; a belt extending around the first and second rotatable pulleys and including first and second portions; a fastener securing the first portion of the belt to the first panel; a fastener securing the second portion of the belt to the first panel; a motor for driving the first pulley: a control system for activating the motor; and, a manually operated control panel mounted on the building structure and operatively associated with the control system to generate a signal to the control system to activate the motor.

In a further embodiment of the invention, I provide an improved access system for a building structure. The access system includes an access opening formed in the building structure and having first and second sides; a horizontally oriented track extending across the opening and including an elongate horizontally oriented space extending along the track; at least a first panel slidably mounted in the access opening on the track, the panel including a leading portion and a rear portion; a first rotatable pulley mounted at a position lateral from the first side; a second rotatable pulley mounted at a position lateral from the second side; a belt extending around the first and second rotatable pulleys and including first and second portions, the first portion extending through the space in the track; a fastener securing the first portion to the panel; a fastener securing the second portion to the panel; a motor for driving the first pulley; and, a control system for activating the motor.

In another embodiment of the invention, I provide an improved access system for a building structure. The improved access system includes an access opening formed in the building structure and having first and second sides; a horizontally oriented track extending across the opening; at least a first panel slidably mounted in the access opening on the track and including a leading portion, a rear portion, a top, and a bottom; a first rotatable pulley mounted at a position lateral from the first side and from the bottom of the panel; a second rotatable pulley mounted at a position lateral from the second side and from the bottom of the panel; a belt extending around the first and second rotatable pulleys and including first and second portions; a fastener securing the first portion the bottom of the panel; a fastener securing the second portion to the bottom of the panel; a motor for driving the first pulley; and, a control system for activating the motor.

In still a further embodiment of the invention, I provide an improved access system for a building structure. The access system includes an access opening formed in the building structure and having first and second sides; a horizontally oriented track extending across the opening; at least first and second panels slidably mounted in the access opening on the track, each of the panels including a leading portion and a rear portion; a first rotatable pulley mounted at a position lateral from the first side; a second rotatable pulley mounted at a position lateral from the second side; a belt extending around the first and second rotatable pulleys and including first, second, and third portions; a fastener securing the first portion to the first panel; a fastener securing the second portion to the first panel; a fastener securing the third portion to the second panel; a motor for driving the first pulley such that the pulley moves the belt and the belt simultaneously moves the first and second panels in opposing directions; a control system for activating the motor; a control panel mounted on the building structure and operatively associated with the control system to generate a signal to the control system to activate the motor.

In still another embodiment of the invention, I provide an improved access system for a building structure. The access system includes an access opening formed in the building structure and having first and second sides; a horizontally oriented track extending across the opening; at least a first panel slidably mounted in the access opening on the track and including a leading portion, a rear portion, a top, and a bottom; a first rotatable pulley mounted at a position lateral from the first side and from the bottom of the panel; a second rotatable pulley mounted at a position lateral from the second side and from the bottom of the panel; a belt extending around the first and second rotatable pulleys and including first and second portions; a fastener securing the first portion to the bottom of the panel; a fastener securing the second portion to the bottom of the panel; guides for directing the belt along a non-linear path intermediate the pulleys; a motor for driving the first pulley; and, a control system for activating the motor.

In yet a further embodiment of the invention, I provide an improved method for retrofitting an access system for a building structure. The access system includes an access opening formed in the building structure and having first and second sides; a horizontally oriented track extending across the opening and including an elongate horizontally oriented space extending along the track, and at least a first panel slidably mounted in the access opening on the track. The panel includes a leading portion and a rear portion. The method including the steps of mounting a first rotatable pulley at a position lateral from the first side; mounting a second rotatable pulley at a position lateral from the second side; extending a belt through the elongate space and mounting the belt on the first and second rotatable pulleys, the belt including a first portion and a second portion; fastening the first portion of the belt to the panel; fastening the second portion of the belt to the panel; and, mounting a motor to drive the belt to move the panel along the track.

Figure 1:
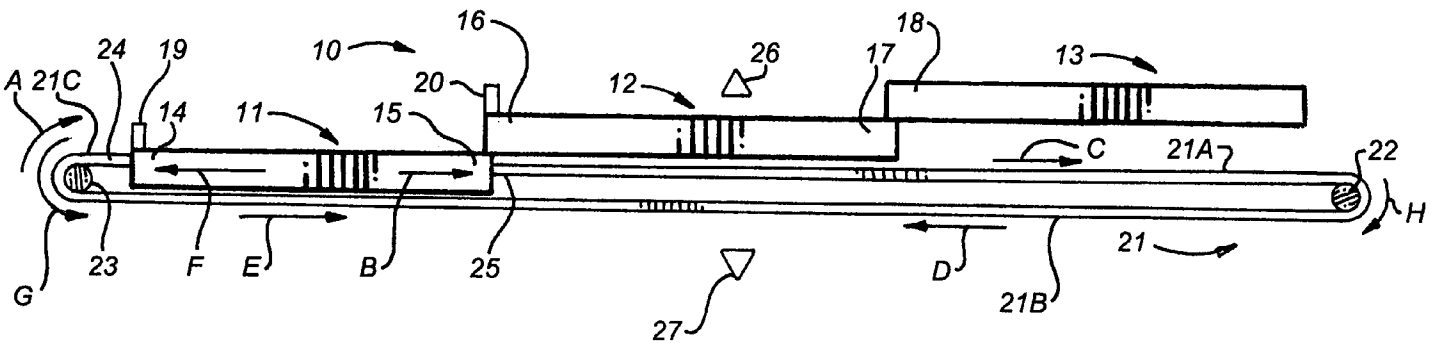
FIG. 1 is a top view illustrating a single action sliding door access system constructed in accordance with the invention.

Turning now the drawings, which depict the presently preferred embodiments of the invention for the purpose of illustration thereof, and not by way of limitation of the invention, and in which like characters refer to corresponding elements throughout the several views, FIG. 1 illustrates a single action sliding door access system constructed in accordance with the invention and generally indicated by reference character 10. In a single action sliding door access system, each sliding door panel moves in the same direction when the access system is being opened, or, is being closed.

Access system 10 includes sliding door panels 11, 12, 13. Each door panel 11 to 13 is parallel to and offset from the other panels and travels in a track 30 (FIG. 5) in conventional fashion. The track 30 can also, if desired, be situation above—instead of below—panels 11 to 13. Panels 11 to 13 can also, if desired, be suspended on arms or rollers or other means that move along a track positioned above panels 11 to 13 when panels 11 to 13 are being laterally displaced in, for example, the directions indicated by arrows B and F.

Panel 11 includes leading portion 14 and rear portion 15. Panel 12 includes leading portion 16 and rear portion 17. Panel 13 includes leading portion 18. Each panel can be constructed as desired but typically includes a rectangular frame circumscribing and holding a pane of glass.

One end 24 of belt 21 is fastened to the leading portion 14 of panel 11. The other end 25 of belt 21 is attached to the rear portion 15 of panel 11. Belt 21 extends around driven pulley 23 and free-wheeling pulley 22. Catch 19 is affixed to leading portion 14 of panel 11. Catch 20 is affixed to leading portion 16 of panel 12.

Figure 10:
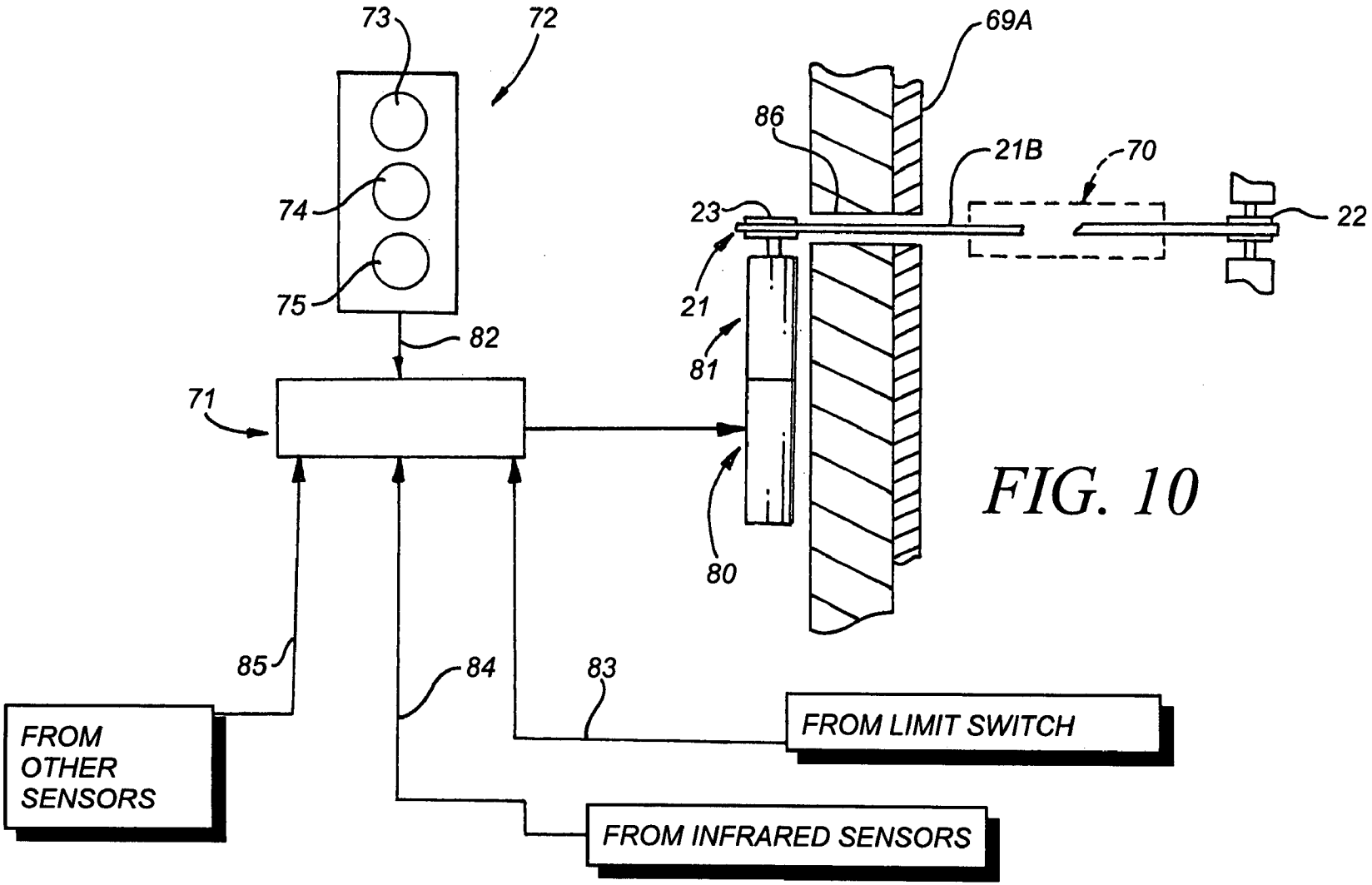
FIG. 10 is a combination section view and schematic diagram illustrating the control system of the invention.

As illustrated in FIG. 10, pulley 23 is turned by a motor 80. Motor 80 typically, although not necessarily, transmits motive power to pulley 23 via a gear assembly 81. If desired, a clutch can be interposed intermediate motor 80 and pulley 23.

A controller 71 receives signals from 82 a manually operated wall mounted switch, from 83 a limit switch (FIG. 8), from 84 infrared sensors 26 and 27, and/or from 85 any other desired sensors or inputs.

Belt 21 extends through an opening 86 formed in the wall and doorjamb 69.

Figure 8:
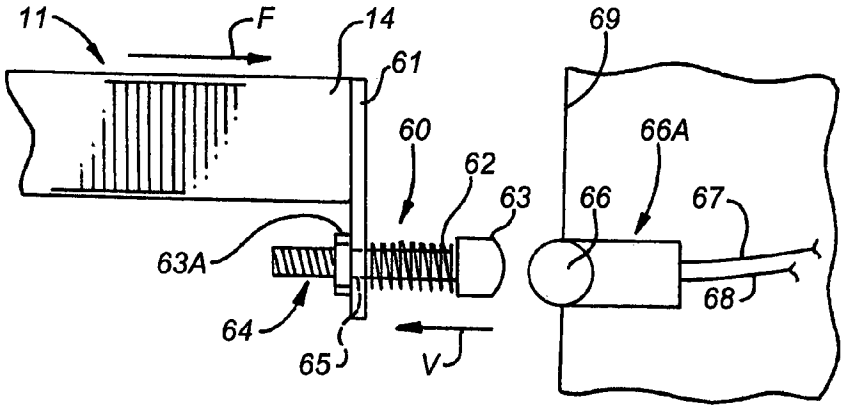
FIG. 8 is a top view illustrating an inertial limit switch utilized in accordance with the invention.
Figure 9:
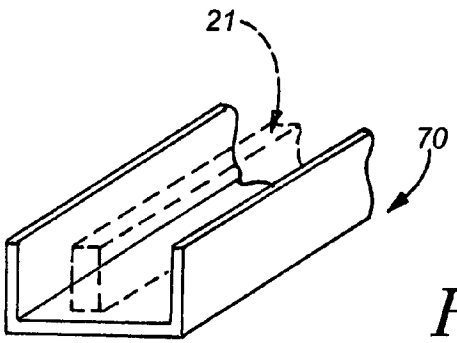
FIG. 9 is a perspective view illustrating a U-shaped channel used in the invention to conceal the belt that displaces sliding door panels.

The limit switch mechanism illustrated in FIG. 8 includes a plate 61 fixedly secured to the leading portion 14 of door 11. A bolt with head 63 and externally threaded leg 64 slidably extends through opening 65 formed through plate 61. Internally threaded nut 63A is threaded on leg 64 and fixedly secured in position thereon. Spring 62 extends between head 63 and plate 61. When panel 11 is moving in the direction of arrow F and head 63 contacts metal bearing 66, head 63 is displaced in the direction of arrow V, compressing spring 62. The force required to compress spring 62 may, if the panel 11 is light and spring 62 is stiff, slow the movement of panel 11. More importantly, however, when head 63 contacts metal ball bearing 66, the limit switch unit 66A is activated and generates an electrical signal that is sent to controller 71 via wires 67, 68 or via other desired signal transmission means such as, but not limited to, radio waves, microwaves, fiber optic signals, etc. When controller 71 receives a signal from unit 66A, it halts the operation of motor 80 such that the inertia of panel 11 causes panel 11 to travel in the direction of arrow F the last short distance to door jamb 69. When the invention is utilized in connection with panels 11 to 13 weighing one hundred pounds or more, the use of the limit switch mechanism is important because it enable a panel 11 to gradually slow down and make a "soft" contact with jamb 69.

Figure 4:
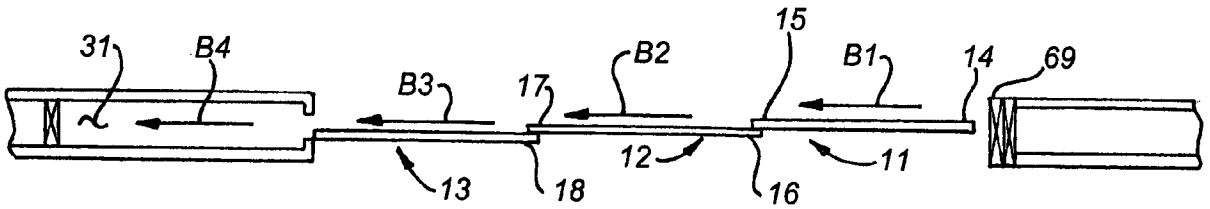
FIG. 4 is a top view of the sliding door access system of FIG. 1 illustrating further construction details thereof.
Figure 5:
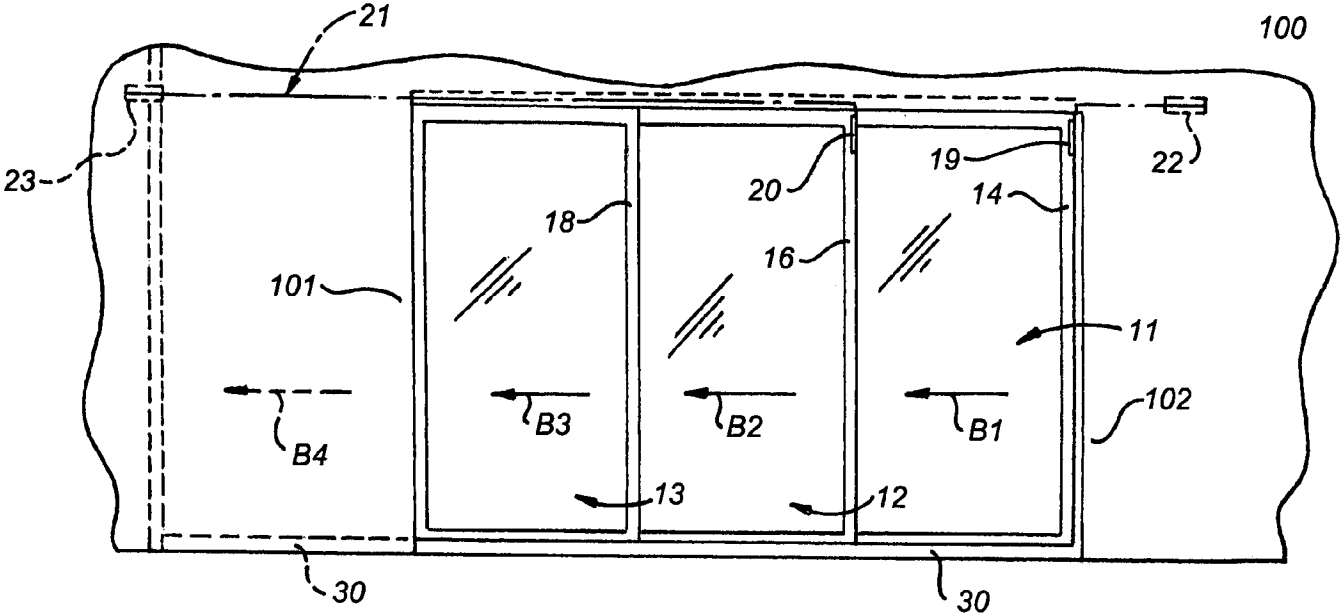
FIG. 5 is a front elevation view of the sliding door access system of FIG. 1 illustrating the mode of operation thereof.
Figure 6:
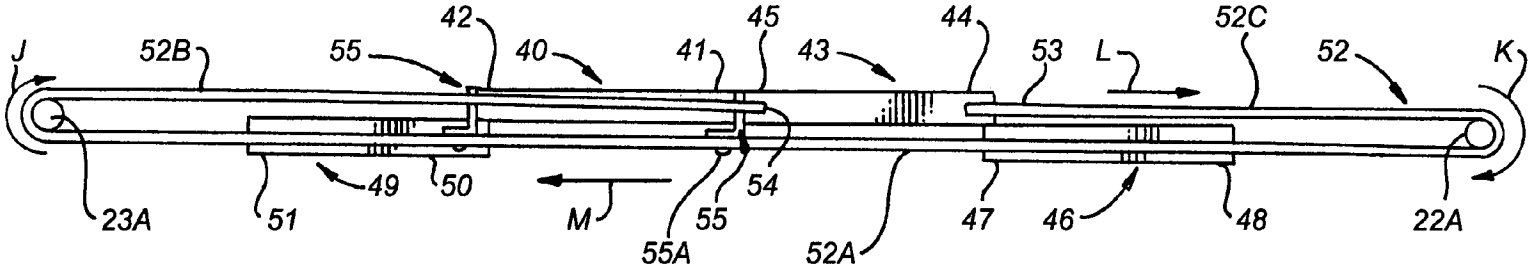
FIG. 6 is a top view illustrating a double action sliding door access system constructed in accordance with the invention.

In operation of the single action sliding door access system of FIGS. 1 to 5, 8 and 10, In FIGS. 1, 4, 6 the access system is in the closed configuration. In operation of the access system of FIGS. 1 to 5, 8 and 10, the user presses the OPEN button 73. A signal is generated which travels from switching unit 72 to controller 71. Controller 71 activates motor 80 such that pulley 23 rotates in the direction indicated by arrow A in FIG. 1. When pulley 23 rotates in the direction of arrow A, section 21A of belt 21 (extending between pulley 22 and rear portion 15) moves in the direction of arrow C; section 21B of belt 21 (extending between pulleys 22, 23) moves in the direction of arrow D; and, section 21C of belt 21 (extending between pulley 23 and leading portion 14) moves in the direction of arrow C. When section 21A moves in the direction of arrow C, panel 11 is pulled in the direction of arrow B. When panel 11 has moved far enough in the direction of arrow B that the leading portion 14 of panel 11 is next to the leading portion 16 of panel 12, latch 19 engages leading portion 16 in the manner shown in FIG. 3 such that panel 11 pulls along panel 12 and panels 11 and 12 move simultaneously in the direction of arrow B. When panel 12 has moved far enough in the direction of arrow B that the leading portion 16 of panel 12 is next to the leading portion of panel 13, latch 20 engages leading portion 18 such that panel 12 pulls along panel 13 and panels 11 to 13 move simultaneously in the direction of arrow B. After panels 11, 12, 13 have moved into pocket 31 (FIG. 4) or to another desired position, controller 71 stops motor 80. A sensor or any other desired means can be used to determine when panels 11 to 13 are in pocket 31 and to send a signal to controller 71 to halt motor 81.

As is illustrated in FIG. 4, when the access system of FIG. 1 is in the closed position and the open button 73 is depressed, causing controller 71 to activate motor 80, panel 11 initially travels in the direction indicated by arrow B1. After panel 11 latches panel 12 in the manner indicated in FIG. 3, panels 11 and 12 travel together in the direction indicated by arrow B2. After panel 12 latches panel 13, panels 11 to 13 travel together in the direction indicated by arrow B3 and thereafter travel together into pocket 31 in the direction indicated by arrow B4.

When the access system of FIGS. 1 and 4 is in the open position, the user can depress the CLOSE button 74. When button 74 is depressed, switching unit 72 generates a signal to controller 71. Controller activates motor 80 to turn driven pulley 23 in the direction of arrow G such that section 21B of belt 21 move in the direction of arrow E and sections 21C and 21A move in directions opposite those in which sections 21C and 21A moved when the access system of FIGS. 1 and 4 was opening. Panel 11 is, consequently, pulled in the direction of arrow F by section 21C. After panel 11 has traveled in the direction of arrow F a distance sufficient for rear portion 15 to be next to front portion 16 of panel 12, a latch 26 on panel 12 engages inner edge 27 of panel 11 such that panel 11 pulls panel 13 along with panel 11, much like a train engine pulls a freight car. After panel 12 has traveled in the direction of arrow F a distance sufficient for rear portion 17 to be next to front portion 18 of panel 13, a latch on panel 13 identical in position and shape to patch 26 engages an inner edge of panel 13 such that panel 12 pulls panel 13 along with panel 12. When panel 11 approach jamb 29 (FIG. 8), head 63 contacts bearing 66 to activate switch unit 66A. Activating unit 66A generates a signal 83 to controller 71. When controller 71 receives the signal 83, controller 71 halts motor 71 such that the inertia of panels 11 to 13 carries them the last short distance until leading portion 14 contacts or is sufficiently close to jamb 69.

The user can, at any time the access system of FIG. 1 or FIG. 4 is opening or closing, push the STOP button 75. Depressing button 75 causes switching unit 72 to generate a signal to controller 71. Controller 71, on receiving such signal, halts the operation of motor 80 and the travel of panels 11 to 13.

Figure 7:
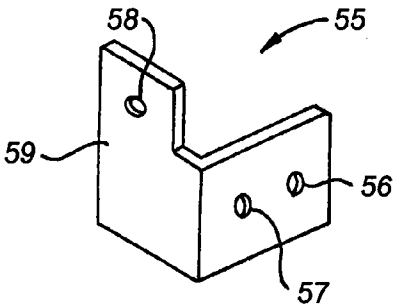
FIG. 7 is a perspective view illustrating a bracket utilized in the double action sliding door access system of FIG. 6 to secure a belt to a selected sliding door panel.

The double action sliding door access system of FIG. 6 includes door panels 40, 43, 46, and, 49. Panel 40 includes leading portion 41 and rear portion 42. Panel 43 includes leading portion 45 and rear portion 44. Panel 46 includes leading portion 47 and trailing portion 48. Panel 49 includes leading portion 50 and trailing portion 51. One end 53 of belt 52 is connected to rear portion 14. The other end 54 of belt 52 is connected to leading portion 45. Brackets 55 (FIG. 7) are attached to leading portion 41 and rear portion 42 with metal screws or other fasteners that extend through apertures 56, 57. Bolts or other fastening means fixedly secure portions of belt 52 to panel 59 of each bracket 55 via aperture 58 formed therein.

The control system illustrated in FIG. 10 is used to operate the access system of FIG. 6.

The double action sliding door access system of FIG. 6 is closed. In operation, the user depresses the OPEN button 73 to activate motor 80 to cause driven pulley 23A to rotate in the direction of arrow J and free-wheeling pulley 22A to rotate in the direction of arrow K. Sections 52B and 52C of belt 52 moves in the direction of arrow L. Section 52A of belt 52 moves in the direction of arrow M. Consequently, section 52A displaces panel 40 in the direction of arrow M. Section 52C pulls panel 43 in the direction of arrow L. Leading portion 41 of panel 40 is provided with a latch equivalent to latch 19 so that when panel 40 has moved a sufficient distance in the direction of arrow M so that leading portion 41 is adjacent leading portion 50, the latch engages leading portion 50 so that panels 40 and 49 move in unison in the direction of arrow M. Similarly, leading portion 45 of panel 43 is provided with a latch equivalent to latch 19 so that when panel 43 has moved a sufficient distance in the direction of arrow L so that leading portion 45 is adjacent leading portion 47, the latch engages leading portion 47 so that panels 43 and 46 move in unison in the direction of arrow L.

Closing the double action sliding door access system of FIG. 6 is accomplished by depressing the CLOSE button 74 such that controller 71 causes motor 80 to rotate driven pulley 23A in a direction opposite that indicated by arrow J.

If desired, in FIG. 6 belt 52 can be continuous and bracket 55 can be utilized to attach belt 52 to leading and rear portions 44, 45 (or to other desired portions) of panel 43.

Safety and operational considerations make the speed at which panels 11 to 13 travel critical in the practice of the invention. Each panel should travel at a speed in the range of one inch to eight inches per second, preferably two inches to six inches per second. Speeds greater than eight inches per second are to be avoided because a heavy panel 11 could crush an animal or child or individual between the panel 11 and jamb 69, causing serious injury.

The gear box 81 ratio used in conjunction with motor 80 is in the range of 6:1 to 100:1. When controller 71 halts motor 80 while panels 11 to 13 (or 40, 43, 46, 49) are still moving, it is important that driven pulley 23A be permitted to free wheel such that belt 21 can continue to move around pulleys 22 and 23 while the inertia of panels 11 to 13 provides the energy to continue moving panels 11 to 13.

Signal 85 can comprise a signal indicating that an individual is stuck or wedged in the access system of FIG. 1 intermediate panel 11 and jamb 69. Such a signal causes controller 71 to stop or reverse the operation of motor 80.

Motor 80 is reversible and can be used to turn driven pulley 23 in opposing directions. If desired, two motors can be utilized. One motor would turn pulley 23 (or 22) in one direction. The other motor would turn pulley 23 (or 22) in the other opposing direction. Motor 80 can be direct drive or clutch driven.

If switching unit 72 is positioned inside a building structure, switching unit 72 can be designed such that depressing button 75 sends a signal to controller 71 that causes controller 71 to disable an outside switch so the outside switch will not operate the access systems of FIGS. 1 and 6.

A single action or double action sliding door access system designed in accordance with the invention can include any desired number of door panels.

Instead of activating controller 71 and motor 80 with the switching unit 72, infrared sensors 26, 27 or other desired sensors can be utilized to generate a signal to controller 71 when an individual approaches or departs the access system of FIG. 1 (or FIG. 6). For example, when an individual walks to within a selected distance of the access system of FIG. 1, sensor 27 sends a signal to controller 71. Controller 71 activates motor 80 to open the panels 11 to 13 in the manner earlier described. After the individual walks a sufficient distance away from the access system, sensor 26 sends a signal to controller 71. Controller 71 activates motor 80 to close the panels 11 to 13 in the manner earlier described.

In FIG. 5, the panels 11 to 13 are mounted in a rectangular access opening formed in a building structure 100. The rectangular opening includes sides 101 and 102.

Figure 11:
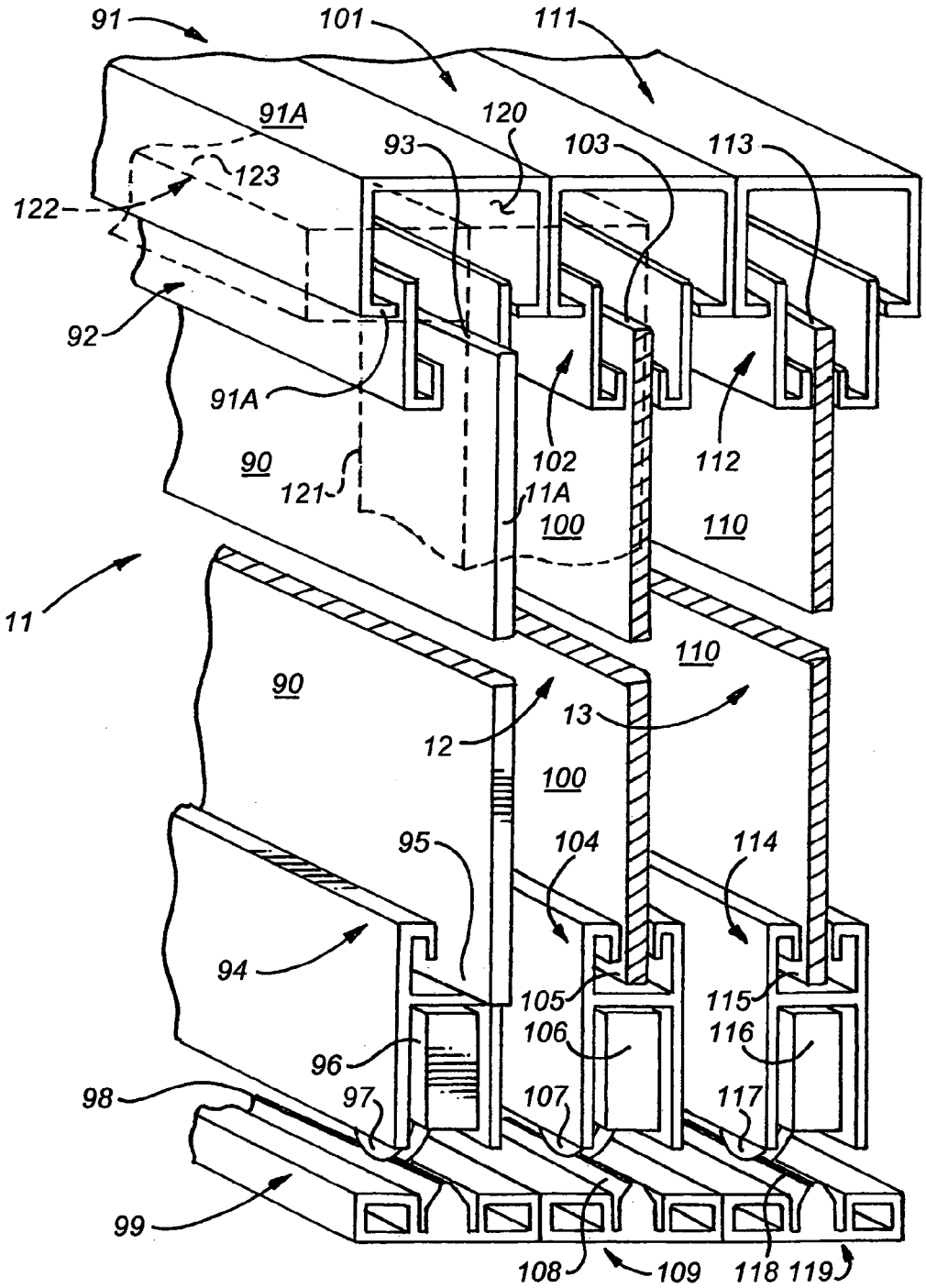
FIG. 11 is a perspective view illustrating further construction details of the sliding door panel access system of FIGS. 1 and 5.

In FIG. 11, panel 11 includes glass pane 90. The upper edge 93 of pane 90 is fixedly received by elongate bracket member 92. Member 92 slidably moves along fixed track or head 91. The lower edge 95 of glass pane 90 is parallel to edge 93 and is fixedly received by elongate bracket 94. Wheel housing 96 is mounted on bracket 94 in conventional fashion. Wheel 97 is rotatably mounted in housing 96. Wheel 97 rotates along upraised tapered member 98 when panel 11 moves laterally in the direction of arrow F or B (FIG. 2) along track 99 and track 91.

Panel 12 includes glass pane 100. The upper edge 103 of pane 100 is fixedly received by elongate bracket member 102. Member 102 slidably moves along fixed track or head 101. The lower edge 105 of glass pane 100 is parallel to edge 103 and is fixedly received by elongate bracket 104. Wheel housing 106 is mounted on bracket 104 in conventional fashion. Wheel 107 is rotatably mounted in housing 106. Wheel 107 rotates along upraised tapered member 108 when panel 12 moves laterally in the direction of arrow F or B (FIG. 2) along track 109 and track 101.

Panel 13 includes glass pane 110. The upper edge 113 of pane 110 is fixedly received by elongate bracket member 112. Member 112 slidably moves along fixed track or head 111. The lower edge 115 of glass pane 110 is parallel to edge 113 and is fixedly received by elongate bracket 114. Wheel housing 116 is mounted on bracket 114 in conventional fashion. Wheel 117 is rotatably mounted in housing 116. Wheel 117 rotates along upraised tapered member 118 when panel 13 moves laterally in the direction of arrow F or B (FIG. 2) along track 119 and track 111.

Track 91 includes elongate inner space 120 extending horizontally beneath flat top member 91A. As can be seen in FIG. 11, the upper portion of bracket member 92 extends upwardly past foot 91A into the lower part of space 120. As will be seen with reference to FIG. 13, a portion of belt 21 extends through and along space 120 in one preferred embodiment of the invention.

The vertical end piece of panel 11 is indicated in FIG. 11 by dashed lines 121 but has been otherwise omitted in FIG. 11 for the sake of clarity. The vertical end pieces of panels 12 and 13 are similarly omitted in FIG. 11. An elongate U-shaped member is indicated by dashed lines 122 in FIG. 11 and includes top panel 123. While portions 21A and 21C of belt 21 can extend at least in part through space 120 in track 91, another portion 21B of belt 21 extends through member 122. An elongate horizontally oriented member (not shown) can, if desired, be attached to the bottom of member 122 to conceal portion 21B of belt 21 inside member 122.

Figure 12:
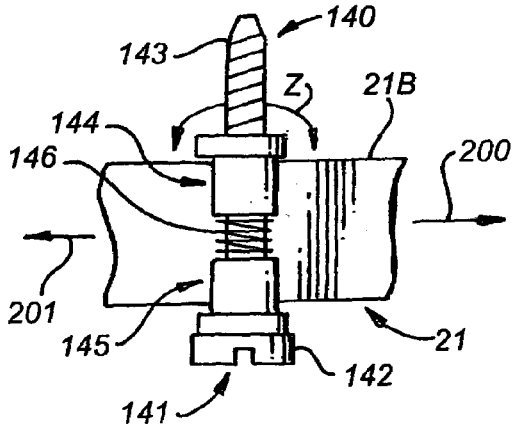
FIG. 12 is side view illustrating a guide unit used to tension and direct a drive belt.
Figure 14:
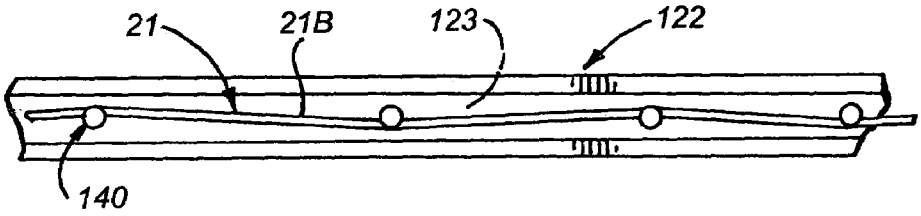
FIG. 14 is a bottom view illustrating the use of the guide unit of FIG. 12 to tension a drive belt in the system of the invention.

FIG. 12 illustrates a guide member 140 used to tension and direct the path of travel of belt 21. Member 140 includes screw 141 including head 142 and externally threaded foot 143 extending from head 142. Identical hollow cylindrical sleeves 144 and 145 are rotatably mounted on foot 143 with spring 146 positioned therebetween. Member 140 is mounted in top panel 123 by threading the distal end of foot 143 into panel 123 such that member 140 extends inside member 122 in the manner illustrated in FIG. 14. FIG. 14 is a bottom view of member 122 with the bottom panel or cover removed so that members 140 are visible, as well as belt 21 coursing through the inner space of member 122. When the distal end of foot 143 is turned into panel 123, sleeve 144 is displaced toward sleeve 145, compressing spring 146. The distance between sleeves 144 and 145 is readily adjusted by varying the length of the distal end of foot 143 that is turned into panel 123. Sleeves 144 and 145 can, but do not necessarily have to, free wheel in the directions of arrow Z when belt 21 moves in the directions indicated by arrows 200 and 201.

Figure 13:
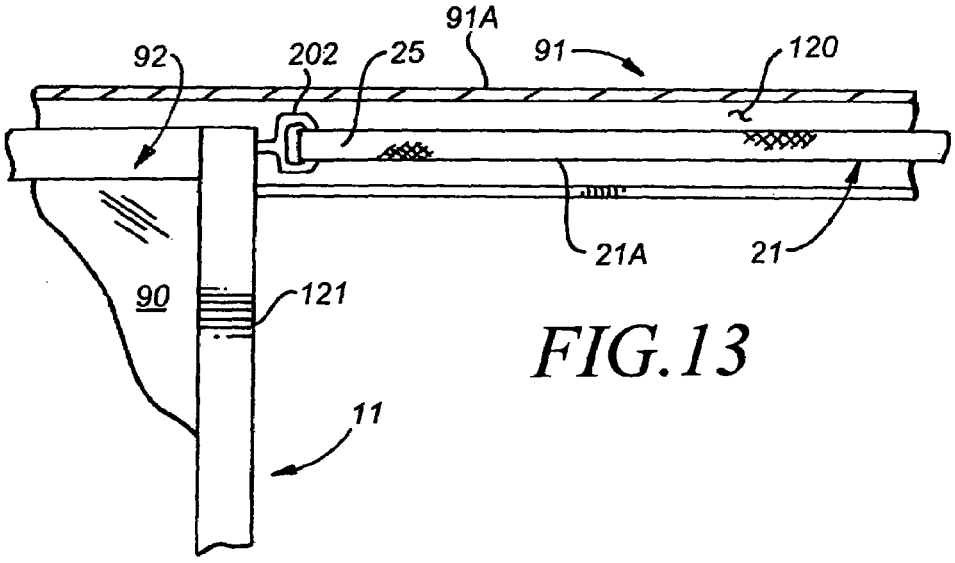
FIG. 13 is a partial side section view illustrating the channeling of the drive belt through a track in the sliding door access system of the invention.

In FIG. 13, fastener 202 secures end 25 of belt 21 to end piece 121 at the trailing edge 15 of panel 11. Importantly, portion 21A of belt 21 extends through space 120 in track 21. This feature of the invention greatly simplifies installation of the motor—pulley—belt system of the invention. Prior art devices position and extend belt 21 along and above the top of track 91 and space 120, making the retrofitting of prior art belt systems costly and impractical.

Retrofitting an existing sliding door system or other building access system with the motive power apparatus of the invention is accomplished by installing pulleys 22 and 23 in the wall of a building structure laterally from the sides of the opening in the building structure which the access system is installed. Pulleys 22 and 23 ordinarily can be readily installed by cutting small openings in the wall of an existing structure and fastening a pulley support structure to a two-by-four or other structure member in the wall. The pulley 23 support structure can, by way of example and not limitation, be the axle on which the pulley is mounted and which extends into and is turned by a motor. If the pulley 22 is not a driven pulley, the pulley support structure can be an axle mounted in the wall such that the pulley can freewheel on the axle and the belt 21 can freely extend around pulley 22 in the manner illustrated in FIG. 2. A belt 21 is fed or extended through the existing space 120 of track 91 (or through a similar space in a lower track 99, since a panel 11 can be pulled from the bottom as well as the top), is extended around pulleys 22 and 23, and is attached to door 11 in the manner illustrated in FIG. 2. A motor 80 to turn at least one of pulleys 22 and 23 is installed. A control system 71, 72 to turn the motor on and off is installed. The motor and control system are connected to a source of electrical or other power. The motor and control system ordinarily can be rather easily installed in the wall of an existing building structure by cutting an opening in the wall adjacent.

Instead of retrofitting an existing system, the belt—motor—control system of the invention can be installed along with a sliding door access system during the initial construction of a building structure.

When an existing sliding door access system is retrofitted with the belt—motor—control system of the invention, the existing system can be manually operated prior to the retrofit (which is usually the case), or, the existing system can include a prior art power system that is being replaced with the belt—motor—control system of the invention.

Belt 21 can be smooth, can be toothed, can comprise rope, can comprise chain, can comprise rubber, etc. If desired, belt 21 can be replaced by a linkage assembly or other mechanical apparatus.

Figure 15:
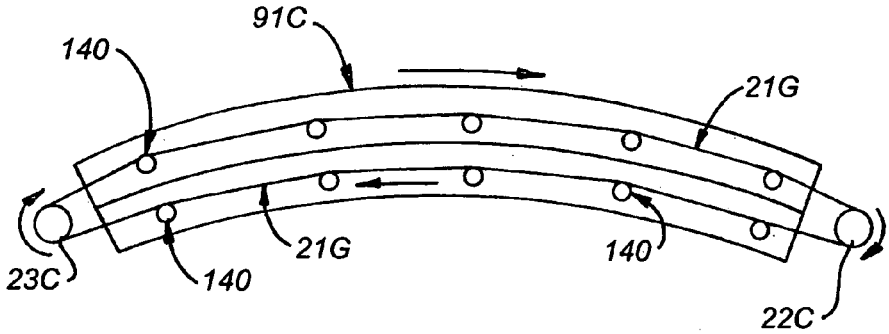
FIG. 15 is a bottom view illustrating the use of the guide unit of FIG. 12 to direct a drive belt along an arcuate path; and, FIG. 16 is a top view illustrating an alternate embodiment of the invention in which sliding doors are opened and closed in directions that are canted with respect to each other.

In FIG. 15, guide units 140 are positioned to guide a belt 21G along an arcuate path of travel through a track 91C. Driven pulley 23C moves belts 21G around freewheeling pulley 21C in the manner indicated by the arrows in FIG. 15.

Figure 16:
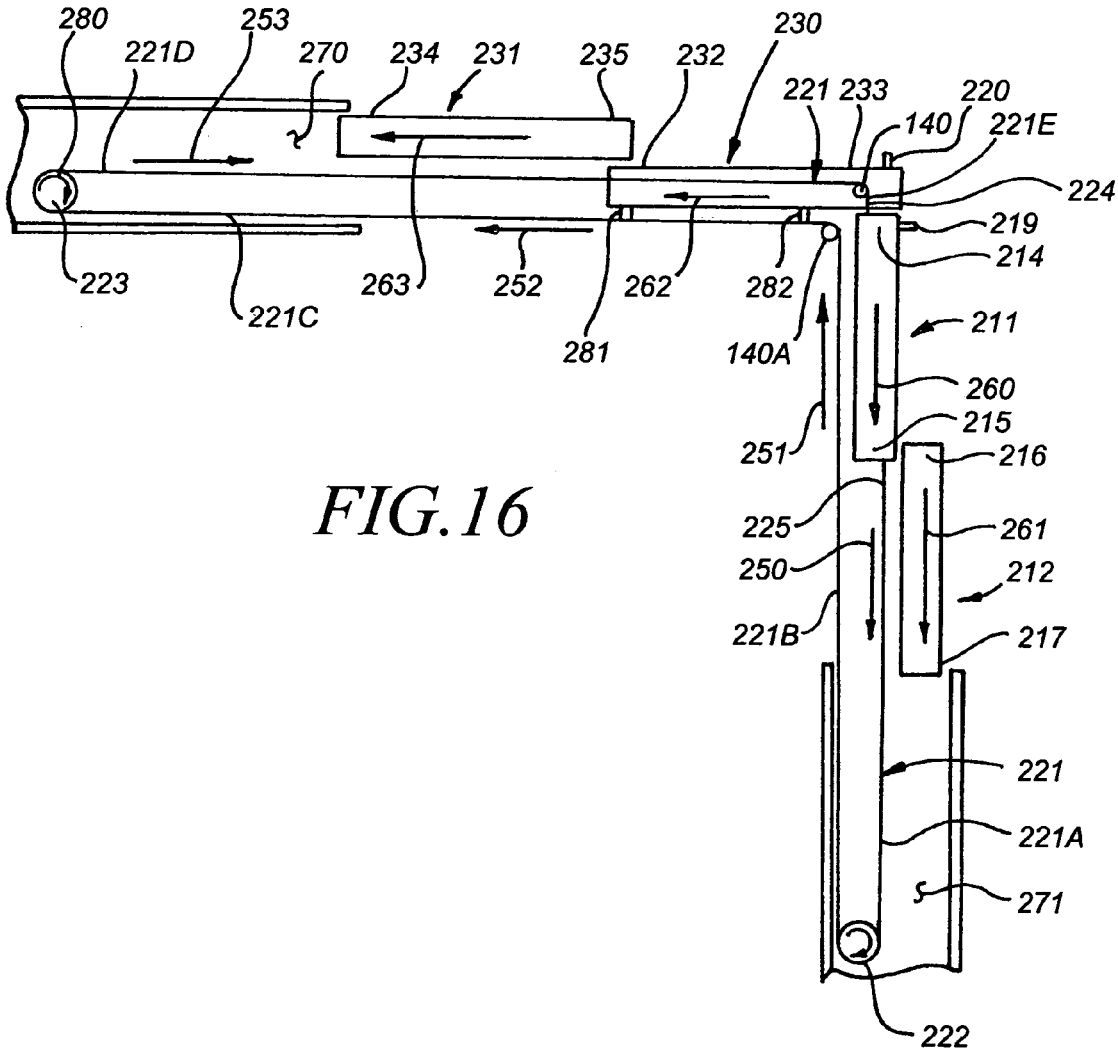

FIG. 16 illustrates an alternate access system constructed in accordance with the invention and including sliding door panels 211, 212, 230, and 231. Panel 211 is parallel to and offset laterally from panel 212. Panel 230 is parallel to and offset laterally from panel 231. Panels 211 and 212 move in directions of travel that are at an angle to—and are not parallel to—the directions of travel in which panels 230 and 231 move. Panels 211 and 212 travel along a track that is canted with respect to the track along which panels 230 and 231 travel.

Panel 211 includes leading portion 214 and rear portion 215. Panel 212 includes leading portion 216 and rear portion 217. Panel 230 includes leading portion 233 and trailing portion 232. Panel 231 includes leading portion 235 and trailing portion 234. Catch 219 is affixed to the leading edge of panel 211. Catch 220 is affixed to the leading edge of panel 230. Brackets 281 and 282 are identical to bracket 55 and are each attached to portion 221C of belt 221.

One end 225 of belt 221 is fastened to the trailing portion 215 of panel 211. The other end 224 is attached to the leading portion 214 of panel 211. Belt 221 extends from trailing edge 215, around pulley 222, around guide unit 140A, around driven pulley 223, and around guide unit 140 to leading edge 214. In FIG. 16, portion 221A of belt 221 extends from edge 215 to pulley 222; portion 221B of belt 221 extends from pulley 222 to guide unit 140A; portion 221C of belt 221 extends from guide unit 140A to pulley 223; portion 221D of belt 221 extends from pulley 223 to guide unit 140; and, portion 221E extends from guide unit 140 to leading edge 214.

In FIG. 16, the door panels are in the closed position. To open the door panels, pulley 223 is rotated in the direction indicated by arrow 280, causing belt 221 to move in the directions indicated by arrows 250 (portion 221A), 251 (portion 221B), 252 (portion 221C), and 253 (portion 221D). When belt moves in the manner indicated by arrows 250 to 253, belt 221 simultaneously moves panel 211 in the direction of arrow 260 and panel 230 in the direction of arrow 262. After panel 211 moves a selected distance in the direction of arrow 260, catch 219 contacts leading portion 216 such that panel 211 and catch 219 pull panel 212 in the direction of arrow 261 simultaneously with the movement of panel 211 in the direction of arrow 260. Similarly, after panel 230 moves a selected distance in the direction of arrow 262, catch 220 contacts leading portion 235 of panel 231 such that panel 230 and catch 220 pull panel 231 in the direction of arrow 263 simultaneously with the movement of panel 230 in the direction of arrow 262. Pulley 223 is driven in the direction of arrow 280 until panels 211 and 212 are nested in pocket 271 and panels 230 and 231 are nested in pocket 270. Pulley 223 is then stopped. Panels 211, 212, 230, 231 are closed by rotating pulley in the direction opposite that of arrow 280. In FIG. 16 panels 211 and 212 are at an angle of ninety degrees with respect to panels 230 and 231. The angle between panels 211, 212 and panels 230, 231 can vary as desired.

Having described the presently preferred embodiments and best mode of the invention in such terms as to enable those of skill in the art to understand and practice the invention, I claim:

1. In combination with a building structure, the building structure including first and second walls at an angle with respect to one another and coterminating at a corner, and including, to walk into and out of the building structure, a first opening formed in said first wall and having a first side spaced apart from said corner, and a second opening formed in said second wall and having a second side spaced apart from said corner, said second opening coterminating with said first opening at said corner in the building structure, improvements for accessing the building structure through said openings, said improvements including (a) a first horizontally oriented track extending across said first opening;

(b) a second horizontally oriented track extending across said second opening and at said angle with respect to said first track;

(c) at least a first panel slidable mounted in said first opening on said first track and having a leading portion and a rear portion;

(d) at least a second panel slidable mounted in said second opening on said second track;

(e) a first rotatable pulley (223) mounted at a position lateral from said first side;

(f) a second rotatable pulley (222) mounted at a position lateral from said second side;

(g) a first guide unit (140A) mounted at said corner;

(h) a second guide unit (140) mounted at said corner;

(i) a belt (221) extending around said first and second pulleys and said first and second guide units such that sections of said belt extend from said first pulley (223) to said corner and generally are at said angle with respect to sections of said belt extending from said second pulley (222) to said corner, said belt including (i) first and second ends (224) (225) connected to said first panel (211), and (ii) an intermediate portion attached to said second panel (230); and, (j) a motor for driving one of said pulleys to move simultaneously each of said first and second panels with respect to said corner.

* * * * *